US006814581B2

(12) United States Patent
Matsuo et al.

(10) Patent No.: US 6,814,581 B2
(45) Date of Patent: Nov. 9, 2004

(54) CONNECTOR FOR TOWING VEHICLE AND METHOD OF MANUFACTURING SAME

(75) Inventors: Yoshiyuki Matsuo, Yokkaichi (JP); Masashi Ooi, Yokkaichi (JP); Yukihisa Nakagawa, Toyota (JP); Kazuhiro Aoki, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/611,242

(22) Filed: Jun. 30, 2003

(65) Prior Publication Data

US 2004/0053525 A1 Mar. 18, 2004

(30) Foreign Application Priority Data

Jan. 7, 2002 (JP) ..... 2002-191960

(51) Int. Cl.[7] ..... H01R 13/52
(52) U.S. Cl. ..... 439/35
(58) Field of Search ..... 439/34, 35, 271–276

(56) References Cited

U.S. PATENT DOCUMENTS 4,545,633 A * 10/1985 McGeary ..... 439/271
5,800,188 A 9/1998 Barber et al. ..... 439/35 X

FOREIGN PATENT DOCUMENTS

GB 2272799 A * 5/1994 ..... 439/35

* cited by examiner

*Primary Examiner*—Renee Luebke
(74) *Attorney, Agent, or Firm*—Gerald E. Hespos; Anthony J. Casella

(57) ABSTRACT

A connection body (41), of a connector for a towing vehicle, to be connected to a wire harness of a to-be-towed object and a connection body (42) of the connector to be connected to a wire harness of a towing vehicle body are approximately cylindrical. Terminals (32, 33) inside the connection bodies (41, 42) are composed of a common metal piece (31). The connector is connected to a wire harness (35) of the towing vehicle body not by using an exclusive cylindrical connector but by directly connecting a core wire to the terminal (32). To prevent water from penetrating into the connector, an O-ring (38), a sealing medium (57), and a rubber plug (59) are mounted on the connector. A protector (37) is installed on an insertion portion of the wire harness (35) of the towing vehicle body into the housing (30).

7 Claims, 5 Drawing Sheets

CONNECTOR FOR TOWING VEHICLE AND METHOD OF MANUFACTURING SAME

BACKGROUND OF THE INVENTION

1. Field of the Invention

The invention relates to a connector for a towing vehicle.

2. Description of the Related Art

A connector for a wire harness of a towing hitch electrically connects wiring harnesses of a vehicle and a to-be-towed object, such as a trailer to each other. Such a connector is standardized in its configuration and size by such as SAE (US Society of Automotive Engineers) or JIS (Japanese Industrial Standard). Thus, compatibility among various kinds of vehicles is secured. In United States of America, the commercially available "Seven-Way Connector" commercially is the standard in the industry.

The "Seven-Way Connector" is compatible with the cylindrical connector at the trailer side in the connection therebetween. There are three kinds of conventional "Seven-Way Connectors".

The first conventional connector for the towing vehicle is shown in FIGS. 4 and 5. This connector has wires 1 that extend from the towing vehicle body and a screw 2 is tightened to fix the electric wires 1 extending from the towing vehicle body to terminals 3*a* that are to be inserted into the connector body 3. Thus, the electric wires are connected to the terminals. However, no waterproof measure is taken in the construction of the connector for the towing vehicle of the first conventional art.

FIG. 6 shows the connector for the towing vehicle disclosed in U.S. Pat. No. 5,800,188. In this second conventional art, the connection portion 11 of the connector to be connected with the trailer-side connector (not shown) is formed cylindrically. Normally, the connector (not shown) at the towing vehicle body side is rectangular. Thus to connect the connector at the towing vehicle body side and the trailer-side connector to each other directly, the opposite-side connection portion 12 of the connector to be connected to the connector at the towing vehicle body side is formed rectangularly. However, in the second conventional art, no waterproof measure is taken for the connector at the towing vehicle body side.

FIG. 7 shows the connector for the towing vehicle of the third conventional art. The connector for the towing vehicle is the standard product of USCAR (US Conference of Automotive Research). The connection portion 21 of the connector (not shown) to be connected to the connection portion 21 at the towing vehicle body side and the connection portion 22 thereof to be connected to the trailer-side connector (not shown) are formed cylindrically. Although not shown, the gap formed on the periphery of metal pieces 23 inserted into the connector, is sealed from water with a sealing medium made of silicon to secure waterproofness.

In the first conventional art, the screw 2 is tightened to fix the electric wires 1 extending from the towing vehicle body to the terminals 3*a* to be inserted into the connector body 3. Thus the screw 2 may be loosened due to travel-caused vibrations, which may lead to failure of contact between the electric wires 1 and the terminals 3*a* inside the connector body 3.

The electric wires 1 are clamped one by one to the terminals 3 inside the connector body 3 with the screw 2. Thus, it takes much time to assemble the connector for the towing vehicle and the manufacturing cost is high.

Further waterproofness of the connector is not considered in the first conventional art. Thus there is a possibility that water penetrates into the portion of connection between the terminals 3*a* and the electric wires 1 and hence electrically conductive portions, such as metal pieces, are corroded. Thus, this connector for the towing vehicle has problems in reliability and durability.

In the second conventional art, the connection portion 11 of the connector to be connected with the trailer-side connector is formed cylindrically. On the other hand, the connection portion 12 of the connector to be connected to the connector at the towing vehicle body side is rectangular. Thus it is necessary to prepare metal pieces for terminals in different configurations so that the metal pieces can be arranged at corresponding positions in the cylindrical connection portion 11 and the rectangular connection portion 12 respectively and to connect the metal pieces in the connection portions 11 and 12 to each other. Therefore the manufacturing cost is high.

Further waterproofness of the connector of the second conventional art is not considered. Thus, this connector for the towing vehicle has problems in reliability and durability.

In the third conventional art, unlike the second conventional art, both the connection portion 22 of the connector to be connected to the trailer-side connector (not shown) and the connection portion 21 thereof to be connected to the connector at the towing vehicle body side are cylindrical. Thus terminals to be inserted into the connection portions 21 and 22 can be arranged smoothly at corresponding positions. Therefore it is possible to use the same metal pieces 23 penetrating through the connection portions 21 and 22 and the number of the metal pieces 23 is lower than that of the connector of the second conventional art.

However, in the connector of the third conventional art, the commercially available rectangular connectors cannot be used for the connector at the towing vehicle body side. Thus it is necessary to prepare the cylindrical exclusive connectors, which increases the manufacturing cost.

In the connector of the third conventional art, the sealing medium made of silicon is applied to the gap on the periphery of the metal pieces 23 inserted into the connector to secure waterproofness of the connector. However, it is necessary to inject the sealing medium deep into the connector. Therefore the sealing medium is liable to attach to the surface of the metal pieces 23. It is very difficult to visually detect the sealing medium that has attached to the surface thereof. Accordingly it is difficult to secure the connector having stable quality.

The hardening period of time of the sealing medium made of silicon that is used in the third conventional art is long after it is applied to the gap.

In any of the connector of the first, second, and third conventional arts, electric wires of the wire harness, at the towing vehicle body side, to be connected to the connectors are partly exposed. Thus when a stone or the like strikes electric wires during travel of the towing vehicle, they may be damaged.

In view of the above-described problems, it is a first object of the present invention to provide a connector for a towing vehicle that can be manufactured at a low cost. It is a second object to improve waterproofness of the connector for the towing vehicle to thereby prevent an electrically conductive portion from being corroded and protect electric wires effectively. It is a third object to improve the quality of the connector for the towing vehicle.

SUMMARY OF THE INVENTION

The invention is a connector for a towing vehicle including a housing formed of an approximately cylindrical first connection body disposed at a rear side of the housing to be connected to a wire harness of a to-be-towed object. An approximately cylindrical second connection body is disposed at a front side of the housing and is to be connected to a wire harness of a towing vehicle body. A first terminal is disposed inside the housing in a range from a portion of connection between the first connection body and the second connection body and is connected to a connector of the wire harness of the to-be-towed object. A second terminal is disposed inside the housing in a range from the portion of connection between the first connection body and the second connection body and is connected to the wire harness of the towing vehicle body. A terminal holder is fitted on an inner periphery of the portion of connection between the first connection body and the second connection body, for holding the first terminal and the second terminal.

In this construction, the first terminal is formed of one end portion of a metal piece; and the second terminal is formed of the other end portion of the metal piece.

Preferably, the connector further includes a first waterproof means fitted between an inner periphery of the housing and a periphery of the terminal holder for making inside the housing waterproof.

Preferably, the connector further includes a waterproof thermosetting sealing medium applied to a gap between the terminal holder and the metal piece.

The end of a core wire of the wire harness of the towing vehicle body preferably has the coating material torn therefrom and the second connector is connected to the end of the core.

A waterproof member preferably is mounted on the end of the wiring harness for preventing water from penetrating into a portion of connection between the second terminal and the core wire.

Preferably, the connector further includes a protector covering the second connection body and an insertion portion of the wire harness of the towing vehicle body into the second connection body, with an end of the wire harness of the towing vehicle body inserted into the second connection body.

Preferably, a bellows-shaped corrugate tube is mounted on a periphery of the wire harness of the towing vehicle body; and a part of an inner periphery of the protector is formed in correspondence to a configuration of the corrugate tube.

The invention also relates to a method of manufacturing a connector for a towing vehicle. The method includes the steps of mounting a metal piece on a terminal holder; applying a sealing medium to a gap between the terminal holder and the metal piece; hardening the sealing medium by overheating the sealing material; and fitting the terminal holder into a housing.

DETAILED DESCRIPTION OF THE PREFERRED EMBODIMENTS

Figure 1:
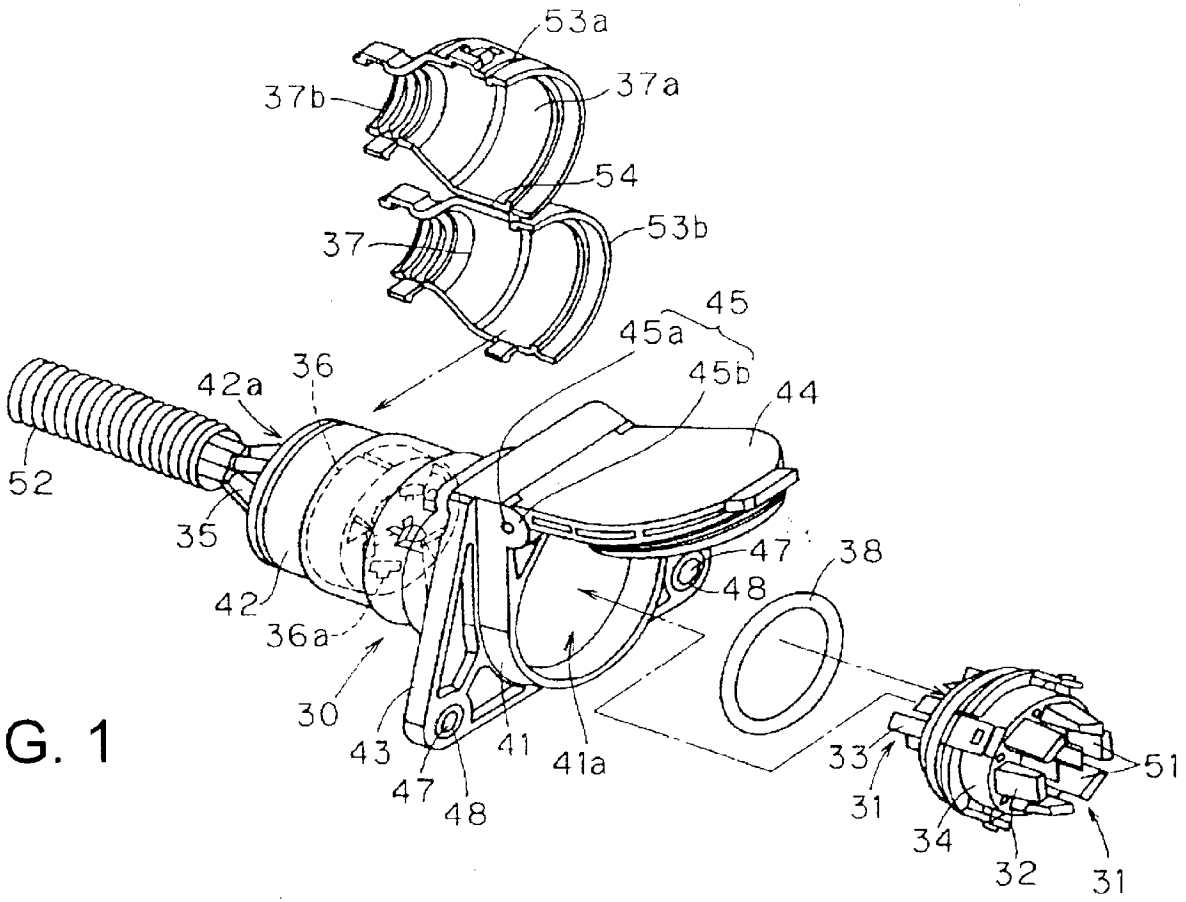
FIG. 1 is an exploded perspective view showing a connector for a towing vehicle according to an embodiment of the present invention.

The connector for a towing vehicle is used for a wire harness of a towing hitch connecting a towing vehicle body and a to-be-towed object such as a trailer to each other. As shown in FIG. 1, the connector for the towing vehicle includes a housing 30. Terminals 32, 33 made of a metal piece 31 are mounted inside the housing 30. The terminals 32, 33 are connected inside the housing 30 to a connector (not shown) of a wire harness of a to-be-towed object and to a wire harness 35 of the towing vehicle body . A terminal holder 34 is provided for fixedly holding the terminals 32, 33 inside the housing 30; and a retainer 36 is provided for holding the configuration of the wire harness 35 of the towing vehicle body inside the housing 30. A protector 37 is provided for protecting a portion of connection between the wire harness 35 of the towing vehicle body and the terminal 33 from the outside of the housing 30; and an O-ring 38 is fitted between an inner periphery of the housing 30 and the periphery of the terminal holder 34 to keep the inside of the housing 30 watertight.

The housing 30 is made of industrial plastic molded in a die. The housing 30 includes an approximately cylindrical first connection body 41, disposed at a rear side thereof for connection to the wire harness of the to-be-towed object. An approximately cylindrical second connection body 42 is disposed at a front side of the housing 30 for connection to the wire harness 35 of the towing vehicle body; and a supporting bracket 43 is provided for fixing the housing 30 to the towing vehicle body. The first connection body 41, the second connection body 42, and the supporting bracket 43 are formed integrally with one another.

The first connection body 41 is approximately cylindrical and female-shaped to fit the male wire harness of the to-be-towed object therein. The supporting bracket 43 is formed on the periphery of the first connection body 41. An open portion 41*a* is formed at the rear end of the first connection body 41. A cover 44 is mounted pivotally on the upper end of the open portion 41*a* through a hinge 45, for closing the open portion when the connector (not shown) of the wire harness of the to-be-towed object is not connected to the first connection body 41. A rotation shaft 45*a* projects out from an end of the cover 44 and is supported by a bearing 45*b* formed at the upper end of the first connection body 41. A coil spring 45*c* is wound on the periphery of the rotation shaft 45*a* and urges the cover 44 in a direction in which the cover 44 closes the open portion 41*a* of the first connection body 41.

Figure 3:
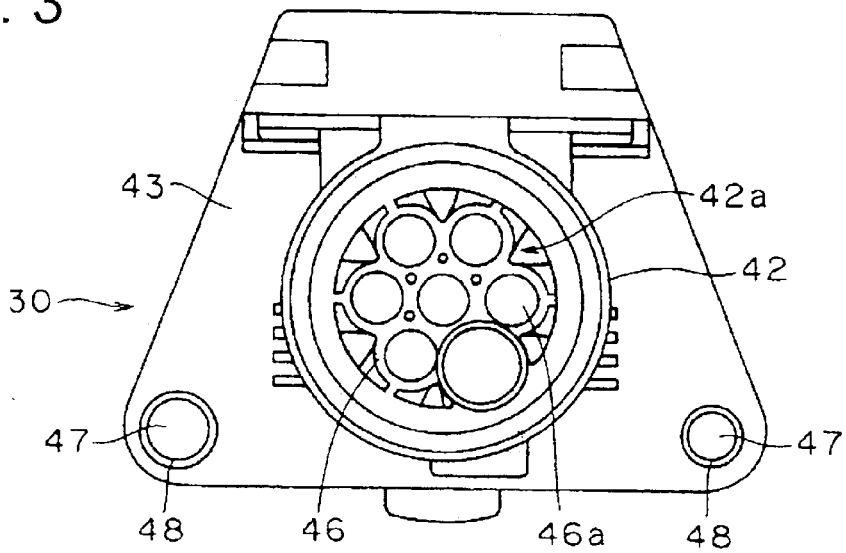
FIG. 3 is a front view showing the connector for the towing vehicle according to the embodiment of the present invention.
Figure 4:
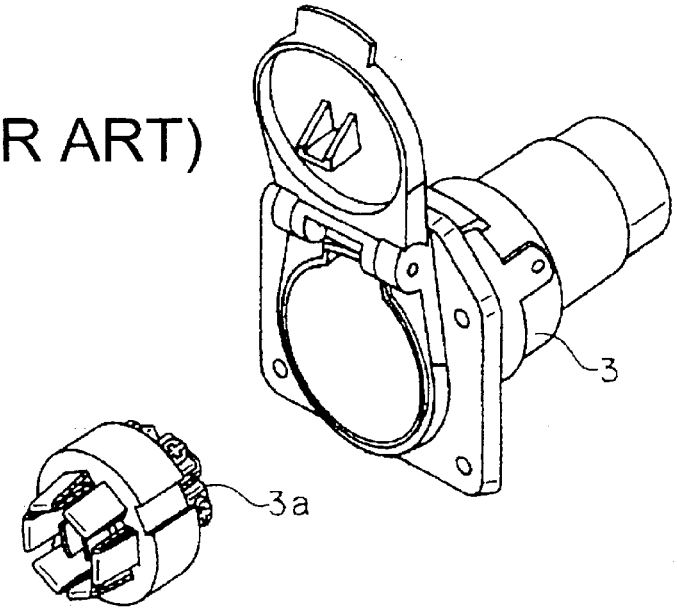
FIG. 4 (PRIOR ART)
FIG. 4 is a perspective view showing a connector for a towing vehicle of a first conventional art.
Figure 5:
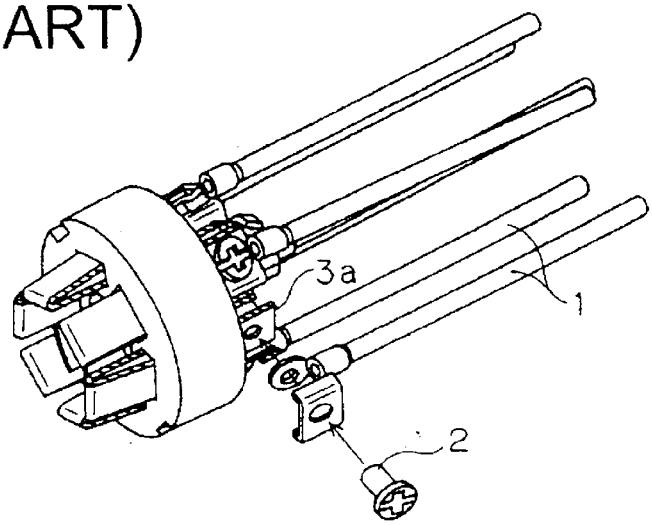
FIG. 5 (PRIOR ART)
FIG. 5 is a perspective view showing the connector for the towing vehicle of the first conventional art in which screws are tightened to connect electric wires to terminals.
Figure 6:
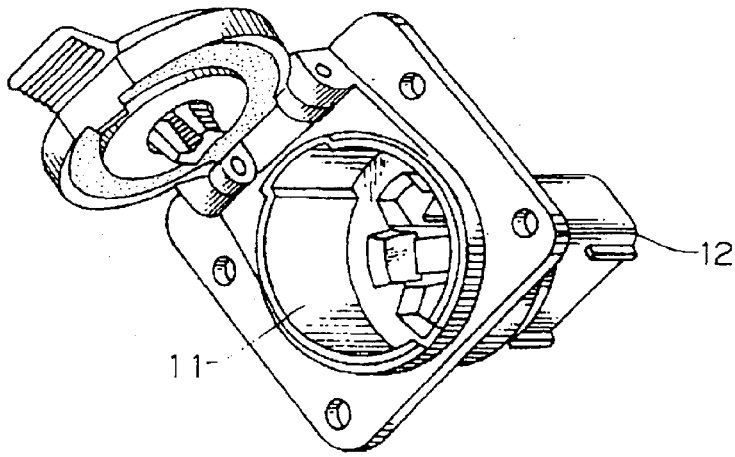
FIG. 6 (PRIOR ART)
FIG. 6 is a perspective view showing a connector for a towing vehicle of a second conventional art.
Figure 7:
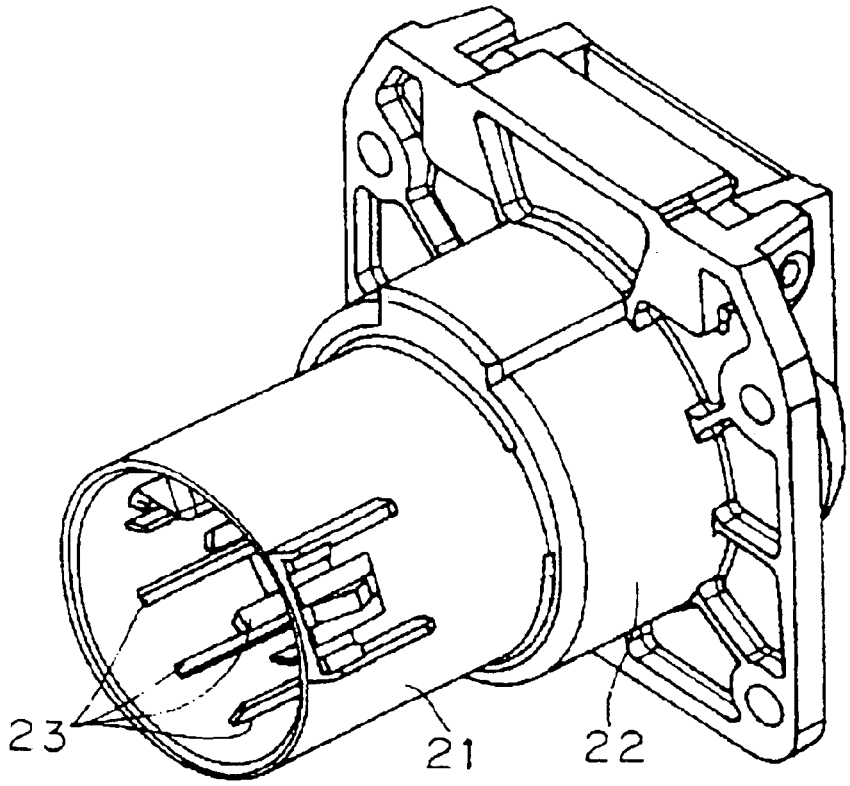
FIG. 7 (PRIOR ART)
FIG. 7 is a perspective view showing a connector for a towing vehicle of a third conventional art.

The second connection body 42 is approximately cylindrical and female-shaped to receive the wire harness 35 of the towing vehicle body thereinto. The rear end of the second connection body 42 is connected integrally to the first connection body 41. As shown in FIG. 3, an inner frame 46 is formed on the inner periphery of a front end 42*a* of the second connection body 42. Positioning holes 46*a* are formed on the inner frame 46 to receive an end of a core wire of the wire harness 35 of the towing vehicle body that has had the coating material torn therefrom and to place the end of the core wire in position.

The supporting bracket 43 is trapezoidal in a front view. A circular press-fit hole 47 is formed at each lower end of the supporting bracket 43. An annular collar 48 is inserted into the press-fit hole 47 for reinforcing the supporting bracket 43 when a press-fit projection (not shown) of the towing vehicle body is pressed into the press-fit hole 47.

Figure 2:
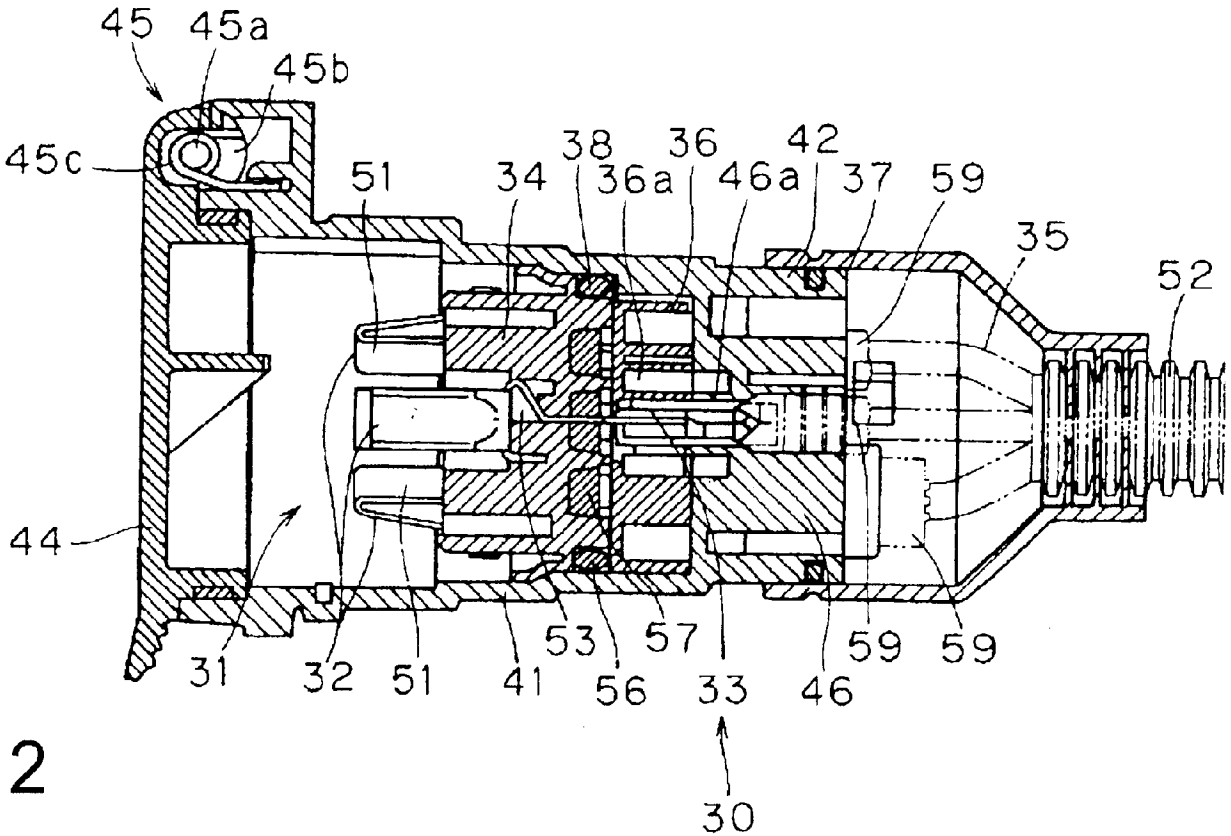
FIG. 2 is a sectional view showing the connector for the towing vehicle according to the embodiment of the present invention.

As shown in FIG. 2, each of the first and second terminals 32, 33 is formed of one bent metal piece 31. The terminals 32, 33 are pressed into the terminal holder 34 which will be described in detail later. The first terminal 32 is disposed at an end of the metal piece 31 that projects toward the first connection body 41 and is bent in the shape of a wedge to form a cylindrical spring member 51 that is radially elastic. The second terminal 33 is disposed at the other end of the metal piece 31 and is inserted through the first connection body 41 from the open portion 41*a* disposed at the side of the first connection body 41. The second terminal 33 then is inserted freely into the positioning hole 46*a* of the inner frame 46 of the second connection body 42. Thus, the metal piece 31 serves as the first terminal 32 to be connected to the wire harness of the to-be-towed object and also as the second terminal 33 to be connected to the wire harness 35 of the towing vehicle body.

The terminal holder 34 is formed circularly in a front view in conformity to the configuration of the inner periphery of the cylindrical first connection body 41. Press-fit holes 53 are formed in the terminal holder 34 and six metal pieces 31 are press fit into the press-fit holes 53 of the terminal holder 34. The press-fit holes 53 are disposed so that the metal pieces 31 are arranged in correspondence to the positioning holes 46*a* of the inner frame 46 inside the second connection body 42.

The retainer 36 is formed circularly in a front view in conformity to the configuration of the inner periphery of a portion of connection between the cylindrical first connection body 41 and the second connection body 42. Free insertion holes 36*a* are formed in the retainer 36 for freely receiving the second terminals 33 supported by the terminal holder 34. The retainer 36 is inserted into the portion of connection between the first connection body 41 and the second connection body 42 from the side of the first connection body 41. The free insertion holes 36*a* of the retainer 36 are disposed in correspondence to the positioning holes 46*a* of the inner frame 46 of the second connection body 42 respectively. The core wires of the wire harness 35 of the towing vehicle body to be inserted into the positioning holes 46*a* from the front side of the second connection body 42 and the second terminals 33 are connected to each other inside the free insertion holes 36*a*.

The protector 37 serves as a means for protecting the towing vehicle body wire harness 35 from the outside, with the end of the wire harness 35 inserted into the second connection body 42. The cylindrical protector 37 includes a connection portion protection part 37*a* covering the periphery of the second connection body 42; and a tube protection part 37*b*, covering a part of a bellows-shaped corrugate tube 52, for protecting the periphery of the wire harness 35 of the towing vehicle body. Semi-cylinders 53*a*, 53*b* of the protector 37 can be opened and closed by means of a hinge 54. The inner periphery of the tube protection part 37*b* conforms to the configuration of the bellows-shaped corrugate tube 52 to prevent penetration of water into the protector 37 from outside.

The O-ring 38 is inserted into the first connection body 41 to fix the terminal holder 34 to the first connection body 41, with the front end of the terminal holder 34 press-fit into the first connection body 41 and to enhance the watertightness of the first connection body 41. A stepped portion 56 is formed on the inner periphery of the connection portion between the first connection body 41 of the housing 30 and its second connection body 42 to receive the O-ring 38.

A thermosetting sealing medium 57 is applied to a gap in the press-fit hole 53 between the terminal holder 34 and the metal piece 31 that has been press-fit into the terminal holder 34. Thus, the watertightness in the portion is securely obtained. The sealing medium 57 is applied to an exposed portion of the press-fit holes 53, before the terminal holder 34 into which the metal piece 31 has been press fit into the first connection body 41. Thus, it is easy to visually detect the sealing medium 57 that ha attached to the surface of the metal piece 31.

As shown in FIG. 2, a separate rubber plug 59 is mounted on an end of the wire harness 35 of the towing vehicle body when the wire harness 35 is inserted into the positioning hole 46*a* to seal the positioning hole 46*a* of the second connection body 42 from water.

The method of assembling the connector for the towing vehicle having the above-described construction will be described below.

Initially each metal piece 31 is inserted into the press-fit hole 53 of the terminal holder 34. Thereafter the thermosetting sealing medium 57 is applied to the exposed portion of the press-fit hole 53 of the terminal holder 34. The sealing medium 57 is overheated to harden it. The sealing medium 57 is applied to the press-fit hole 53, before the terminal holder 34 is inserted into the housing 30. Thus, the sealing medium 57 that has attached to the surface of the metal piece 31 can easily be detected visually.

The cover 44 then is opened and the retainer 36 is inserted into the first connection body 41 from the open portion 41*a*. The retainer 36 then is pressed into the second connection body 42 disposed forward from the first connection body 41. At this time, the retainer 36 is disposed in such a way that the free insertion holes 36*a* of the retainer 36 correspond to the positioning holes 46*a* of the inner frame 46 of the second connection body 42.

Thereafter the O-ring 38 is inserted into the first connection body 41 from the open portion 41*a* thereof and is pressed forward until the O-ring 38 contacts the stepped portion 56 formed on the inner periphery of the connection portion between the first connection body 41 and the second connection body 42.

The terminal holder 34 with the press-fit metal piece 31 and the sealing medium 57 is inserted into the first connection body 41 so that the second terminals 33 supported by the terminal holder 34 are inserted freely into the free insertion holes 36*a* of the retainer 36.

The O-ring 38 keeps the gap between the periphery of the terminal holder 34 and the inner periphery of the housing 30 watertight, and the sealing medium 57 keeps the press-fit hole 53 of the terminal holder 34 watertight. Thus, the inside of the housing 30 is kept waterproof.

The wire harness 35 of the towing vehicle body is inserted into the second connection body 42 from the positioning hole 46*a* of the inner frame 46 thereof. The core wire of the wire harness 35 of the towing vehicle body and the second terminal 33 thus are connected to each other inside the free insertion hole 36*a* of the retainer 36.

The rubber plug 59 of separate type is mounted on the end of the wire harness 35 of the towing vehicle body. Therefore at the front end of the second terminal 33, the rubber plug 59 seals the positioning hole 46*a* of the inner frame 46 of the second connection body 42 from water. As a result, the waterproofness of the front end of the second terminal 33 can be obtained securely obtained.

The semi-cylinders 53*a*, 53*b* of the protector 37 are opened by means of the hinge 54, and the protector 37 then is approached to the end of the second connection body 42 and the wire harness 35 of the towing vehicle body. The hinge 54 then is pivoted to close the semi-cylinders 53*a*, 53*b*. As a result, the end of the second connection body 42 and the wire harness 35 of the towing vehicle body are covered with the protector 37. At this time, the connection portion protection part 37*a* of the protector 37 covers the second connection body 42, and the tube protection part 37*b* covers the corrugate tube 52 of the wire harness 35 of the towing vehicle body. The corrugate tube 52 is bellow-shaped, and the configuration of the inner periphery of the tube protection part 37*b* corresponds to the configuration of the bellows-shaped corrugate tube 52. Thus, water cannot penetrate into the protector 37 from the outside.

Thereafter a predetermined press-fit lever of the towing vehicle body is pressed into the press-fit collar 48 of the supporting bracket 43 of the housing 30 to fix the connector to the vehicle body.

The cover 44 of the housing 30 is opened when the to-be-towed object, such as a trailer, is mounted on the vehicle body. Then a connector (not shown) of a male to-be-towed wire harness is inserted into the open portion 41*a* of the first connection body 41 to connect the connector thereto.

As described above, the rear-side first connection body 41 to be connected to the connector of the wire harness of the to-be-towed object and the front-side second connection body 42 to be connected to the wire harness 35 of the towing vehicle body are approximately cylindrical. Thus the disposition of the terminals 32, 33 inside the housing 30 can be set similarly. Further the terminals 32, 33 can be composed of one metal piece 31. Therefore the connector for the towing vehicle of the present invention uses a smaller number of component parts than that of the second conventional art. Thus the connector of the present invention can be manufactured at a lower cost for component parts than that of the second conventional art.

The second connection body 42 is connected directly to the ends of respective electric wires of the wire harness 35 of the towing vehicle body. Thus it is unnecessary to use a connector to be connected exclusively to the second connection body 42. Therefore the cost for component parts spent on the connector for the towing vehicle of the present invention is lower than that spent on the connector for the towing vehicle of the third conventional art which requires the exclusive cylindrical connector.

The thermosetting sealing medium 57 is used to seal the surface of the gap generated in the press-fit hole 53 of the terminal holder 34. Thus it is possible to shorten a hardening period of time, make the manufacturing efficiency higher, and make the manufacturing cost lower than the third conventional art.

As apparent from the foregoing description, the connector for the towing vehicle of the present invention can be manufactured at a low cost.

The metal piece 31 is press-fit into the terminal holder 34, and then the sealing medium 57 is applied to the gap generated in the press-fit hole 53 of the terminal holder 34. The metal piece 31 for the terminals 32, 33 then is inserted into the housing 30. Therefore the sealing medium 57 can be injected into the gap with high workability. Sealing medium 57 deposits on the surface of the metal piece 31 cause electrical non-conductivity. However, such deposits of sealing medium 57 easily can be detected visually. Thus it is easy to improve the quality of the connector for the towing vehicle.

The rubber plug 59 of separate type is mounted on the end of the wire harness 35 of the towing vehicle body. Therefore, the rubber plug 59 at the front end of the second terminal 33 is capable of easily sealing the positioning hole 46*a* of the inner frame 46 of the second connection body 42 from water. Thereby the waterproofness of the front end of the second terminal 33 can be obtained securely.

The sealing medium 57 and the O-ring 38 are capable of easily preventing water from penetrating into the housing 30 from the rear or the front thereof.

Furthermore the protector 37 is mounted on the portion of connection between the wire harness 35 of the towing vehicle body and the terminal 33 in such a way as to cover the second connection body 42 and the corrugate tube 52 of the wire harness 35 of the towing vehicle body. Therefore the portion of the connector on which the wire harness 35 is mounted can be protected securely. In particular, the inner periphery of the tube protection part 37*b* of the protector 37 is formed in correspondence to the configuration of the corrugate tube 52. Thus it is possible to reliably protect this portion from the environment.

As apparent from the foregoing description, the connector of the present invention is waterproofed to a higher extent than the connector of the first through third conventional arts. Further the end of the wire harness 35 of the towing vehicle body can be protected from the environment.

What is claimed is:

1. A connector for a towing vehicle comprising:

a housing having opposite front and rear ends, an approximately cylindrical first connection body at the rear end of said housing for connection to a wire harness of a to-be-towed object; and an approximately cylindrical second connection body at the front end of said housing for connection to a wire harness of a towing vehicle body;

a first terminal disposed inside said housing an connected to a connector of said wire harness of said to-be-towed object;

a second terminal disposed inside said housing and connected to an exposed core wire of said wire harness of said towing vehicle body; and a terminal holder fitted on an inner periphery of said housing for holding said first terminal and said second terminal, wherein said first terminal is formed of a first end portion of a predetermined metal piece;

said second terminal is formed of a second end portion of said predetermined metal piece;

a bellows-shaped corrugated tube mounted on a periphery of said wire harness of said towing vehicle body; and a protector covering said second connection body and a portion of said wire harness of said towing vehicle body inserted into said second connection body, a art of an inner periphery of said protector being formed in correspondence to a configuration of said corrugated tube.

2. The connector of claim 1, further comprising a first waterproof means fitted between an inner periphery of said housing and a periphery of said terminal holder, thus securing waterproofness inside said housing.

3. The connector of claim 2, further comprising a waterproof thermosetting sealing medium applied to a gap between said terminal holder and said metal piece.

4. The connector of claim 1, wherein a waterproof member for preventing water from penetrating into a portion of connection between said second terminal and said core wire is mounted on said wire harness of said towing vehicle body at an end thereof.

5. A connector for a towing vehicle, comprising:

a unitarily formed housing having opposite front and rear ends, an approximately cylindrical first connection body at the rear end of said housing for connection to a wiring harness of a to-be-towed object, an approximately cylindrical second connection body at the front end of said housing for connection to wire harness of a towing vehicle body, an inner periphery extending through the housing from the front end to the rear end and;

a retainer in the inner periphery of the housing;

an O-ring in the inner periphery of the housing;

an integrally formed terminal holder having opposite front and rear ends and a plurality of press-fit holes extending through the terminal holder from the front end to the rear end, the terminal holder being disposed in the inner periphery of the housing substantially adjacent and rearward of the retainer and in sealing engagement with the O-ring;

terminal fittings disposed respectively in the press-fit holes of the terminal holder so that opposed ends of the respective terminal fittings project forwardly and rearwardly from the respective front and rear ends of the terminal holder; and a thermosetting sealing medium in a portion of each press fit hole adjacent the front end of the terminal holder for sealing the respective terminal fittings to the terminal holder.

6. The connector of claim 5, further comprising a protector covering said second connection body and an insertion portion of said wire harness of said towing vehicle body.

7. The connector of claim 6, wherein a bellows-shaped corrugated tube is mounted on a periphery of said wire harness of said towing vehicle body; and a part of an inner periphery of said protector is formed in correspondence to a configuration of said corrugated tube.

* * * * *